United States Patent [19]

Smillie

[11] 4,310,045

[45] Jan. 12, 1982

[54] PROCESS FOR FORMING SHELL SAND WITH MOLTEN PHENOLFORMALDEHYDE RESIN

[75] Inventor: John G. Smillie, Aurora, Ill.

[73] Assignee: Aurora Industries, Inc., Montgomery, Ill.

[21] Appl. No.: 133,558

[22] Filed: Mar. 24, 1980

Related U.S. Application Data

[63] Continuation of Ser. No. 784,112, Apr. 4, 1977, abandoned.

[51] Int. Cl.[3] ..... B05D 7/00; B22C 1/22

[52] U.S. Cl. ..... 164/527; 260/38; 428/404; 427/221

[58] Field of Search ..... 260/DIG. 40, 38; 427/221, 222, 134; 428/404, 403; 164/43

[56] References Cited

FOREIGN PATENT DOCUMENTS 753163 7/1968 United Kingdom ..... 427/221

*Primary Examiner*—Sam Silverberg

*Attorney, Agent, or Firm*—Leydig, Voit, Osann, Mayer & Holt, Ltd.

[57] ABSTRACT

A process of coating sand with a phenolformaldehyde resin to produce a shell sand for use in shell molds and cores. The process comprises the steps of reacting phenol and formaldehyde at an elevated temperature to produce hot liquid phenolformaldehyde resin as a reaction product, transferring the hot liquid phenolformaldehyde resin to a mixing station while maintaining the resin at an elevated temperature to prevent solidification of the hot reaction product, mixing the hot liquid phenolformaldehyde resin with preheated sand at the mixing station to coat the sand with the resin, and cooling the coated sand to solidify the resin. When the phenol and formaldehyde are reacted at a location remote from the mixing station, the hot liquid phenolformaldehyde resin is transferred from the reaction station to the mixing station in insulated containers. The liquid resin is preferably maintained at a temperature of at least 250° F. until it is mixed with the preheated sand. The process yields a superior shell sand for forming shell molds or shell cores.

9 Claims, No Drawings

PROCESS FOR FORMING SHELL SAND WITH MOLTEN PHENOLFORMALDEHYDE RESIN

This is a continuation, of application Ser. No. 784,112 filed Apr. 4, 1977 now abandoned.

DESCRIPTION OF THE INVENTION

The present invention relates generally to shell molding and, more particularly, to processes for coating the sands used in forming shell molds and cores. The invention specifically relates to an improved process for coating such sands with phenolformaldehyde resin.

It is a principal object of the present invention to provide an improved shell sand coating process which provides a superior product at a lower cost, as compared with previously known shell sand coating processes.

One of the important specific objects of the invention is to provide such an improved shell sand coating process that produces shell sand capable of forming shell molds and cores with improved tensile strength in a shorter time period, as compared with previously available shell sands, with attendant increases in productivity.

Another important specific object of the invention is to provide such an improved shell sand coating process that permits the use of a relatively low cost phenolformaldehyde resin in relatively small quantities and which minimizes resin losses.

Still another object of the invention is to provide an improved shell sand coating process as described above which requires less energy than many of the processes used heretofore.

Others objects and advantages of the invention will be apparent from the following detailed description.

Although the invention will be described in connection with certain preferred embodiments, it will be understood that it is not intended to limit the invention to these particular embodiments. On the contrary, it is intended to cover all alternatives, modifications and equivalents that may be included within the spirit and scope of the invention as defined by the appended claims.

In accordance with the present invention, there is provided a process of coating sand with a phenolformaldehyde resin to produce a sand for use in shell molds and cores, the process comprising the steps of (a) reacting phenol and formaldehyde at an elevated temperature to produce hot liquid phenol formaldehyde resin as a reaction product, (b) transferring the hot liquid phenolformaldehyde resin to a mixing station while maintaining the resin at an elevated temperature to prevent solidification of the hot reaction product, (c) mixing the hot liquid phenolformaldehyde resin with preheated sand at the mixing station to coat the sand with the resin, and (d) cooling the coated sand to solidify the resin.

Phenolformaldehyde resins have been widely used heretofore in the coating of shell sands. This resin has been applied to the sand by at least two different techniques, namely by a hot coating technique in which initially solid resin is melted while being mixed with the sand, and by a cold coating technique in which initially solid resin is dissolved in a solvent which is then mixed with the sand. The present invention is an improvement in the hot coating technique.

In the hot coating techniques that have been used previously, the phenolformaldehyde resin has been added to the muller, where the sand and resin are mixed, in solid form. The resin is generally supplied in the form of "flakes", which are produced by solidifying the liquid reaction product of phenol and formaldehyde on a cooling surface such as a rotating drum. Normally the liquid phenolformaldehyde reaction product is distilled to reduce the water content thereof before it is solidified into flakes. This cooling and flaking operation results in the loss of a certain amount of volatiles, such as free phenol and low molecular weight novolaks, from the liquid phenolformaldehyde, and it also produces a certain amount of "fines" which are too powdery or dusty to be used in the sand coating process. Consequently, these fines must be separated from the usable flakes and either recycled or used for other applications. The cooling and flaking operation is also a costly and time consuming operation. The solid resin flakes produced by this process are normally packed in bags or other suitable containers, and the handling and shipment of these containers usually results in further losses of the phenolformaldehyde resin. When the resin ultimately arrives at the sand coating plant, it must be heated above its melting point in order to coat the sand grains. This is normally accomplished by heating the sand to a temperature on the order of about 300° F. before it is mixed with the resin in the muller.

The present invention stems from the discovery that the use of the hot liquid phenolformaldehyde resin in its original form, without ever solidifying it, produces a superior shell sand while at the same time eliminating the expense, resin losses and other disadvantages flowing from the conventional resin flaking operation. For example, it has been found that the use of the virgin liquid phenolformaldehyde resin permits the sand to be coated with the use of less resin, and shell molds and cores produced from the resulting coated sands can be formed in a shorter time and exhibit increased tensile strength. Moreover, the use of the virgin liquid resin permits a considerable saving of energy because there is no need to reheat and melt a resin which has been previously cooled and solidified; indeed, it has been found that the liquid resin can be mixed with sand that has been heated to temperatures as low as 230° F., as contrasted with the 300° F. temperatures that have been used when the sand is mixed with solid flake resin. Furthermore, the use of the virgin liquid resin completely eliminates the time, expense and material losses that are inherent in the cooling and solidifying operation that is normally used to produce the solid resin flakes. For example, because the resin is never solidified and flaked, there is no need to segregate usable resin flakes from the powdery fines, and there is no need to package the resulting solid flakes in containers which inherently lead to further resin losses.

In the normal production of phenolformaldehyde resin, phenol and formaldehyde are reacted at a temperature on the order of 212° F., and the resulting reaction product is then normally distilled at a temperature on the order of about 320° F., to remove most of the water. The liquid resin is then often cooled to a temperature in the range of about 270° to 280° F. for mixing with selected additives.

It is this final 270°–280° F. resin that is preferably mixed with the sand in the process of this invention. In the event that the sand coating plant is not at the same location as the phenolformaldehyde synthesis plant, the hot liquid resin may be shipped in insulated containers with only slight reductions in the temperature of the hot liquid resin. For example, 280° F. liquid resin has been placed in insulated containers for a period of four hours during shipment from a resin synthesis plant to a sand coating plant, and the temperature dropped only 20° to 260° F. The resin is preferably maintained at a temperature of at least 250° F. until it is mixed with the preheated sand in the muller in order to minimize the energy requirements for preheating the sand, but resins at even lower temperatures can be used to advantage by simply preheating the sand to a higher temperature. In any event, however, the liquid resin should be maintained at a temperature sufficiently high to prevent solidification of the resin before it is mixed with the sand. In general, this means that the resin temperature should not be permitted to drop below 160° F., which is about the minimum solidification point for the lowest melting phenolformaldehyde resins. The melting point of any particular resin is determined primarily by the amount of water and free formaldehyde removed from the liquid resin during distillation of the reaction product. When the resin is cooled and solidified to produce solid resin flakes, the melting point of the resin is generally increased somewhat due to the loss of moisture and volatile compounds during the cooling and solidifying operation.

The hot liquid phenolformaldehyde resin is mixed with the preheated sand in a conventional muller as in the case of conventional hot coating processes. Hexamethylenetetramine and water, along with a wax additive if desired, are added to the muller after an initial mixing period in order to cure the resin coating on the sand grains. The mixing is then continued for a secondary mixing period to obtain uniform solidification of the resin coating on the sand grains throughout the entire mass within the muller. The temperature of the coated sand is also reduced during the secondary mixing period due to the quenching effect of the water and the hexamethylenetetramine. The initial mixing period is preferably about 60 to 90 seconds, followed by a secondary mixing period of about 30 to 60 seconds.

One of the advantages of the present invention is that the amount of resin required to be mixed with the sand in the muller is less than the amount of the resin required in previous hot coating processes. The amount of resin required in the shell and is dependent on the particular application in which the sand is used, but in general the sands prepared by the process of the present invention require less resin for any given application than the shell sands that have been previously available. In general, the shell sand could include at least about 2% by weight resin. The resin reductions permitted by this invention will be demonstrated by the working examples to be set forth below.

After the sand grains have been coated with resin in the muller, the resulting resin-coated sand is discharged from the muller and dried and screened, crushed and sized. The sand is then ready for use in the forming of a shell mold or shell core.

The forming of the shell mold or shell core with the resin-coated sand prepared by the process of this invention is carried out in conventional hot patterns or core boxes. As is well known to those familiar with shell molding, the forming of a shell mold or core normally involves a blowing or dumping step in which the resin-coated sand is applied to the surface of the pattern or core box, a dwell or invest step during which the sand is compacted on the surface of the pattern or core box, and a curing step during which the resin is solidified to provide an integral shell mold or core which can be removed from the pattern or core box. The time required for these successive steps varies widely depending on the type of investment procedure and equipment utilized, as well as the size and shape of the mold or core. However, regardless of what type of procedure and equipment is utilized, the process of the present invention permits significant reductions in the time requiring for both the invest step and the curing step, thereby providing significant reductions in the total cycle time involved in the forming of any given shell mold or core.

The following working examples are given as illustrations and are not intended to limit the scope of the invention. The results of certain tests conducted on the coated sands are also described. These tests were made substantially in accordance with the following procedures:

COLD TENSILE STRENGTH

A Dietert #400-1 motor driven, arc type strength machine (made by Harry W. Dietert Co., Detroit, Mich.) with Dietert #610-N tensile core strength accessory is used to break specimen sand "biscuits" formed in a pattern at 450° F., cured for one minute, and then cooled to room temperature. The cold tensile strength in psi is read directly from the shear scale on the machine.

LOSS ON IGNITION

Two grams of the shell sand to be tested are placed in a pre-weighed boat, and the boat and sand are then placed in a muffle furnace maintained at 1700° F. and heated for 45 minutes. The boat and sand are then removed from the furnace, allowed to cool to room temperature, and weighed again. The final weight of the boat and sand is substracted from the initial weight of the boat and sand, and the resulting difference is divided by 2 and multiplied by 100 to obtain the percent loss on ignition.

EXAMPLE NO. 1

Phenolformaldehyde resin was prepared by reacting phenol and formaldehyde at a temperature of 212° F. and distilling the resulting reaction product at 320° F. to produce virgin liquid phenolformaldehyde resin containing about 5% by weight free phenol, less than 1% by weight free formaldehyde, and about 2 to 3% by weight water. This product was cooled to about 285°–290° F., mixed with a conventional wax additive, and then shipped about 160 miles in insulated containers to a sand coating plant. When the liquid resin reached the sand coating plant, it was at a temperature of 280° F. The total time elapsed between the preparation of the virgin liquid resin and the use of the liquid resin in the sand coating plant was about four hours. While still at a temperature of about 275°–280° F., 20 pounds of the liquid resin was mixed in a conventional Barber Green muller with 800 pounds of Wedron 65 AFS sand which was preheated to 230° F. After 90 seconds of mixing, the resulting mixture was quenched by adding 11 pounds of liquid containing 3 pounds of hexamethylenetetramine, 3.35 ounces of wax, and the balance water. Mixing was then continued for another 45 seconds after which the coated sand was dried, crushed and sized. The resulting resin-coated sand was tested for cold tensile strength ("C.T.") at curing times of 30, 45 and 60 seconds, and loss on ignition ("L.O.I."), with the following results:

| | |
|---|---|
| C.T. 30 sec. | 640 psi |
| C.T. 45 sec. | 650 psi |
| C.T. 60 sec. | 670 psi |
| L.O.I. | 2.90% |

EXAMPLE NO. 2

For purposes of comparison, Example No. 1 was repeated using solid phenolformaldehyde flake resin from two different suppliers in place of the liquid resin and preheating the sand to 270° F. instead of 230° F. for the first resin, and to 290° F. for the second resin. Tests on the resulting product yielded the following results:

| Resin No. 1 | |
|---|---|
| C.T. 30 sec. | 540 psi |
| C.T. 45 sec. | 545 psi |
| C.T. 60 sec. | 550 psi |
| L.O.I. | 2.90% |
| **Resin No. 2** | |
| C.T. 30 sec. | 530 psi |
| C.T. 45 sec. | 530 psi |
| C.T. 60 sec. | 545 psi |
| L.O.I. | 2.90% |

I claim as my invention:

1. In a process of producing a shell mold or core wherein sand is coated with a phenolformaldehyde resin, said process comprising the steps of (a) reacting phenol and formaldehyde at an elevated temperature to produce a reaction product consisting essentially of hot liquid phenolformaldehyde resin having a solidification temperature above about 160° F., (b) transferring the hot liquid phenolformaldehyde resin to a mixing station while maintaining the resin at an elevated temperature to prevent solidification of the hot reaction product, (c) mixing the hot liquid phenolformaldehyde resin with preheated sand at said mixing station to coat the sand with the resin.

2. A process of coating sand as set forth in claim 1 wherein said phenol and formaldehyde are reacted at a temperature of at least about 212° F.

3. A process of coating sand as set forth in claim 1 wherein the hot liquid phenolformaldehyde resin is maintained in liquid from the time it is produced to the time it is mixed with the preheated sand, by continuously insulating the resin to minimize heat losses therefrom.

4. A process of coating sand as set forth in claim 1 wherein said phenol and formaldehyde are reacted at a reaction station that is remotely located from said mixing station, and said hot liquid phenolformaldehyde resin is transferred from said reaction station to said mixing station in insulated containers.

5. A process of coating sand as set forth in claim 1 wherein said hot liquid phenolformaldehyde resin is maintained at a temperature of at least about 250° F. until it is mixed with the preheated sand.

6. A process of coating sand as set forth in claim 1 wherein the sand is preheated to a temperature within the range of from about 220° F. to about 250° F. before the sand is mixed with the hot liquid phenol formaldehyde resin.

7. A process of coating sand as set forth in claim 1 wherein the hot liquid phenolformaldehyde resin and the preheated sand are mixed at a temperature in the range of from about 220° F. to about 250° F.

8. A process of coating sand as set forth in claim 1 wherein the amount of resin mixed with the sand at least is about 2% by weight of the sand.

9. A process as set forth in claim 1 which includes the further step of forming a shell mold or shell core from the coated sand.

* * * * *